US005493989A

United States Patent [19]

Anderson

[11] Patent Number: 5,493,989

[45] Date of Patent: Feb. 27, 1996

[54] ADJUSTABLE FIN BOX SYSTEM

[76] Inventor: Steven C. Anderson, Box 2549, Olympic Valley, Calif. 96146

[21] Appl. No.: 265,954

[22] Filed: Jun. 27, 1994

[51] Int. Cl.[6] ..... B63B 3/38

[52] U.S. Cl. ..... 114/138; 441/79

[58] Field of Search ..... 441/79, 132; 114/138, 114/141

[56] References Cited

U.S. PATENT DOCUMENTS 5,176,096 1/1993 Molnar et al. ..... 441/79

FOREIGN PATENT DOCUMENTS 2659931 9/1991 France ..... 441/79

*Primary Examiner*—Jesus D. Sotelo

[57] ABSTRACT

A watercraft containing a fin box system, said fin box system comprising a chamber of spaced side walls and end walls, and a fin with a fin base that can travel vertically, horizontally or at an angle within said chamber; said chamber is fixed within said watercraft, and said fin base having a device to expand and contract itself against said side walls or end walls can be releasably fixed at an infinite number of positions within said fin box.

6 Claims, 4 Drawing Sheets

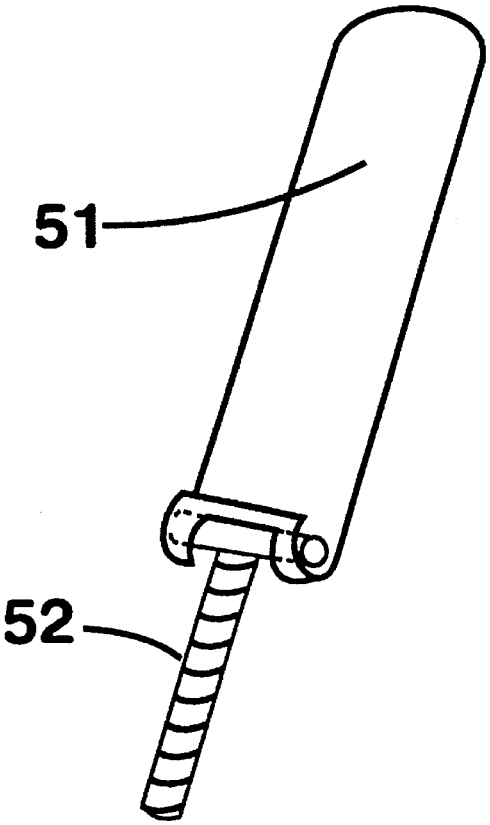
FIG. 4
FIG. 5
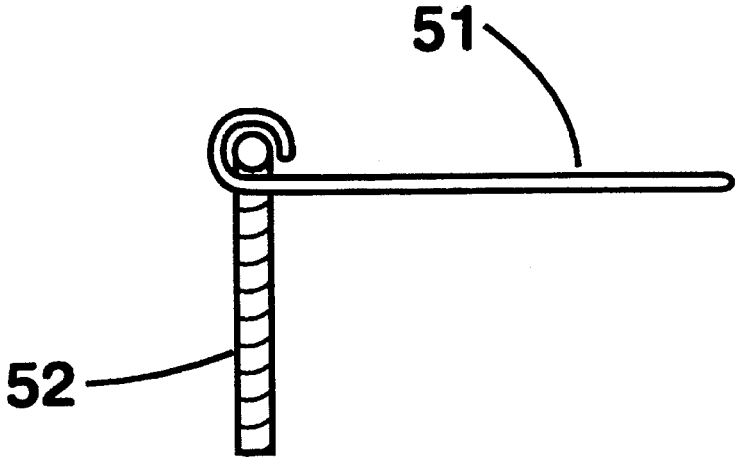

ADJUSTABLE FIN BOX SYSTEM

FIELD OF INVENTION

This invention is directed to adjustable fin box systems for sailboards or other water craft using a fin to provide lateral resistance, and directional control.

BACKGROUND ART

A change of one half inch in fin depth can profoundly change the performance of a sailboard or surfboard. Fin boxes now in use (except for the following references ) do not allow the fin to be adjusted vertically. A windsurfer or surfer must remove a larger fin from the fin box and replace it with another smaller fin if he wishes to reduce fin depth.

U.S. Pat. Nos. 5,224,435 and 5,148,761 provide a means to adjust the depth of a fin used in saiboards. Both of these inventions have tried to make the fin adjustable while sailing. This feature may be important to racers, but I do not feel that a complicated adjustment system is necessary for the recreational sailor. While my system is not adjustable while sailing, it does allow the sailor to quickly adjust fin depth in the water. U.S. Pat. No. 5,148,761, and 5,224,435 only allow the user to chose between two radically different fixed fin depth positions, while my fin system will allow the user to adjust the fin depth, angle, and horizontal placement of the fin in very small increments. The inventions shown in U.S. Pat. Nos. 5,224,435, and 5,148,761 are not well suited for surf boards, or sailboards using swept back surf style fins. My fin system will work for any style fin currently being made.

OBJECTS AND ADVANTAGES

An object of my invention is to provide a simple, low cost, quick, effective, and lightweight means to adjust the depth, angle, and horizontal placement, in small increments, of a fin in a fin box system. Another object of my invention is to provide such a device that is of new and novel design, of rugged and durable nature, and one otherwise well suited to the uses and purposes for which it is intended.

Other and further objects of my invention will appear from the following specifications and accompanying drawings which form a part hereof. In carrying out the objects of my invention, however, it is to be understood that its essential features are susceptible of change in design and structural arrangement with only one preferred and practical embodiment being illustrated in the accompanying drawings, as is required.

BRIEF DESCRIPTION OF THE DRAWINGS

In the accompanying drawings which form a part hereof and wherein like numbers of reference refer to similar parts throughout:

FIG. 4 is a perspective view of a modified toggle bolt that could be used instead of Screw 32.

FIG. 5 shows the modified toggle bolt in FIG. 4 with Arm 51 in a horizontal position.

Figure 1:
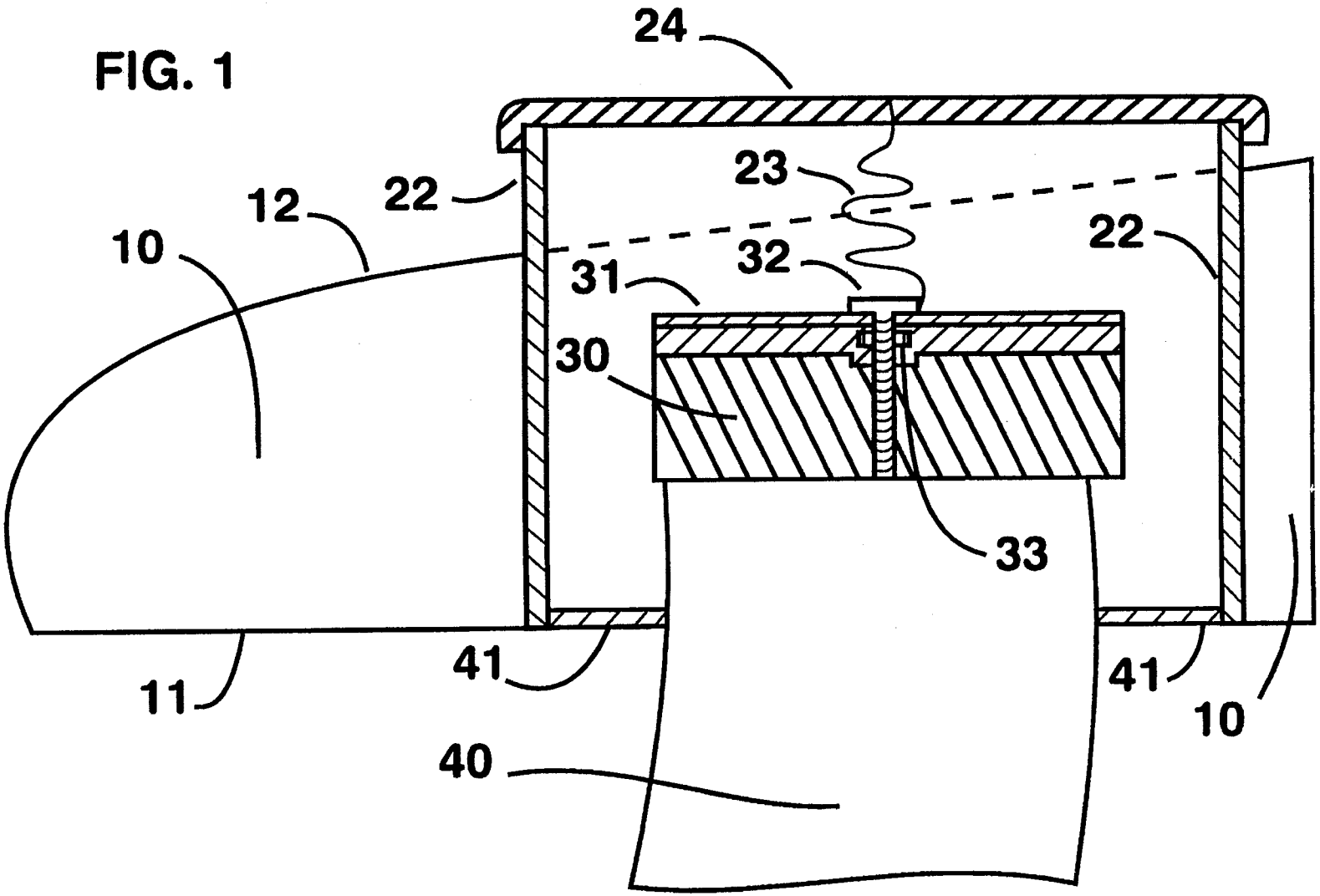
FIG.1 shows the rear portion of a sailboard with my fin box installed. The fin is only partially shown. This drawing is a cross section stern to bow through Screw 32.

| LIST OF REFERENCE NUMERALS | |
|---|---|
| 10 | Sailboard |
| 11 | Bottom surface of Sailboard 10 |
| 12 | Top surface of Sailboard 10 |
| 20 | Fin box |
| 21 | Spaced side wall of Fin box 20 |
| 22 | Spaced end wall of Fin box 20 |
| 23 | Safety cable |
| 24 | Cap |
| 30 | Fin base |
| 31 | Wedge |
| 32 | Screw |
| 33 | Nut on Screw 32 |
| 34 | Washer plate (alternate embodiment only) |
| 40 | Fin |
| 41 | Gasket |
| 51 | Arm on Toggle bolt 52 |
| 52 | Toggle bolt (substitute for Screw 32) |

DESCRIPTION OF THE PREFERRED EMBODIMENT

A chamber with Spaced side walls 21 and Spaced end walls is formed from fiberglass cloth and epoxy resin or other suitable material. Said chamber, shall be called Fin box 20. Fin box 20 is bonded in Sailboard 10 with the bottom of Fin box 20 flush with Bottom of sailboard 11 and the top of Fin box 20 is flush or extending above Top of sailboard 12, as shown in FIG. 1.

Figure 2:
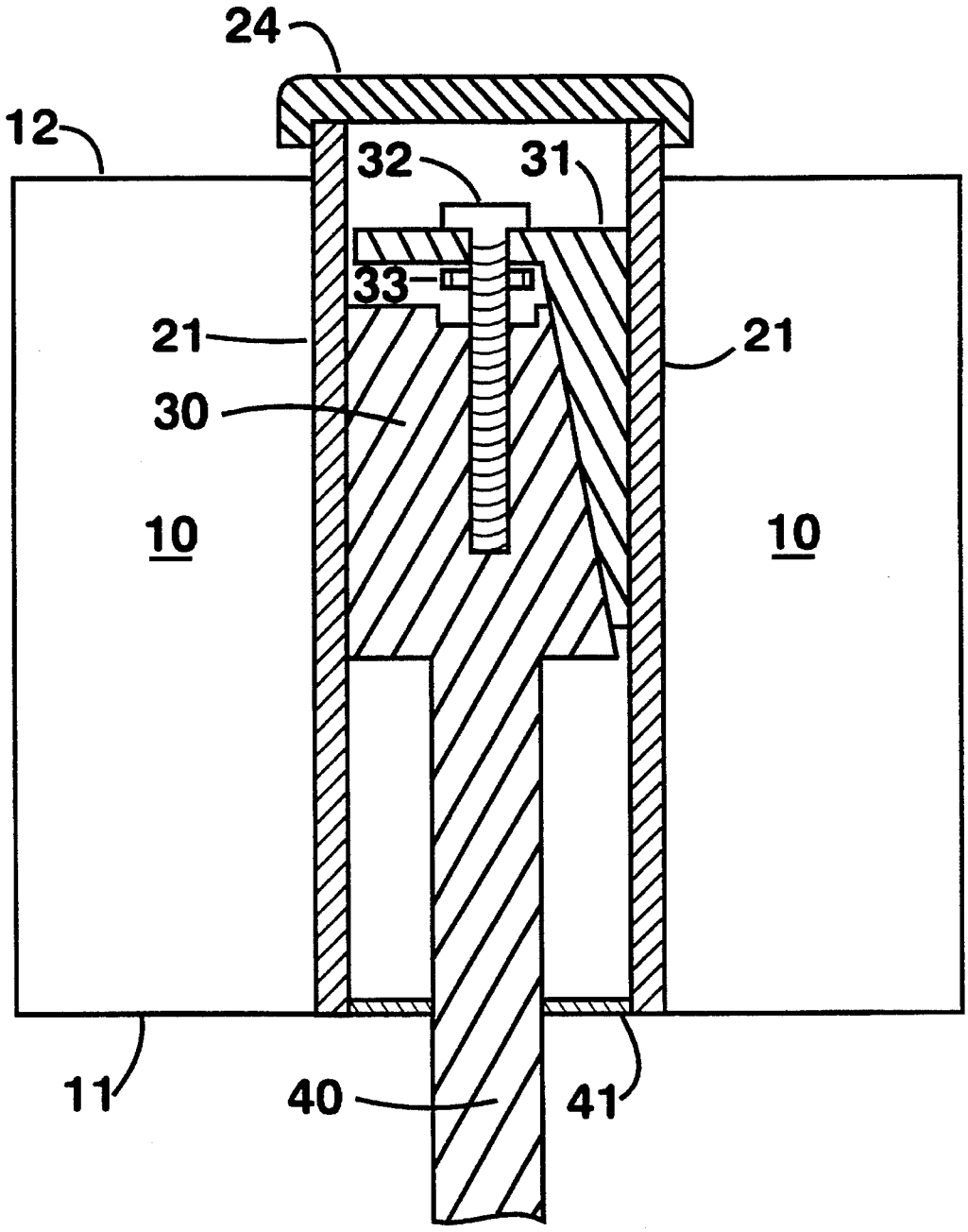
FIG.2 is a cross section of Fin box 20 port to starboard through Screw 32.

Fin base 30, is molded from epoxy resin around the upper portion of Fin 40. Fin base 30 is marginally smaller than Spaced side walls 21 of Fin box 20, as shown in FIG. 2. Fin base 30 is considerably smaller than Spaced end walls 22 of Fin box 20 as shown in FIG. 1. Referring to FIG. 2, Fin base is now run through a table saw putting an angle on one of it's surfaces parallel to Side walls 21. Wedge 31 is molded from aluminum (I used a combination of aluminum and epoxy) to be marginally larger than the area cut off by the table saw from Fin base 30. A hole larger than Screw 32 is bored through Wedge 31. Screw 32, a stainless steel machine screw, is inserted through said hole in Wedge 31 as shown in FIG. 2. Screw 32 is threaded into Fin base 30 as shown in FIG. 2. Nut 33, made of stainless steel, is permanently fixed with epoxy to Screw 32 just under Wedge 31, as shown in FIG. 2. Fin base 30 has a recessed area under Nut 33 as shown in FIG. 2. Wedge 31 is assembled to Fin base 30 as shown in FIG. 2. Gasket 41, made of rubber or other suitable material, is fixed inside of Fin box 20 and flush with Bottom of sailboard 11. Cap 22, made of rubber or other suitable material, is fitted around or inside of the top of Fin box 20, as shown in FIG. 2. Safety cable 23, made from stainless steel wire, is fitted from screw 32 to Cap 24 as shown in FIG. 2.

The fin system is now ready to be used. Fin 40 is inserted from top of sailboard 10 into Fin box 20. Fin 40 is free to move vertically, horizontally, or at an angle inside Fin box 20. The user now locates Fin 40 into it's desired position. Screw 32 is now tightened forcing Wedge 31 to slide over the beveled side of Fin base 30 . As screw 32 is continued to be tightened, Fin base 30 and Wedge 31 are expanded against Spaced side walls 21 of Fin box 20. With sufficient tightening of Screw 32, Fin 40 will be fixed in place in Fin box 20. To change the position of Fin 40, Screw 32 is backed out. Nut 33 contacts Wedge 31 forcing Wedge 31 upward, causing Wedge 31 to disengage from the beveled side of Fin base 30, thus the outward pressure is released, and Fin 40 can be moved to a new location.

This fin box system could work for surfboards, or other watercraft using a fin for lateral resistance, and directional control.

Figure 3:
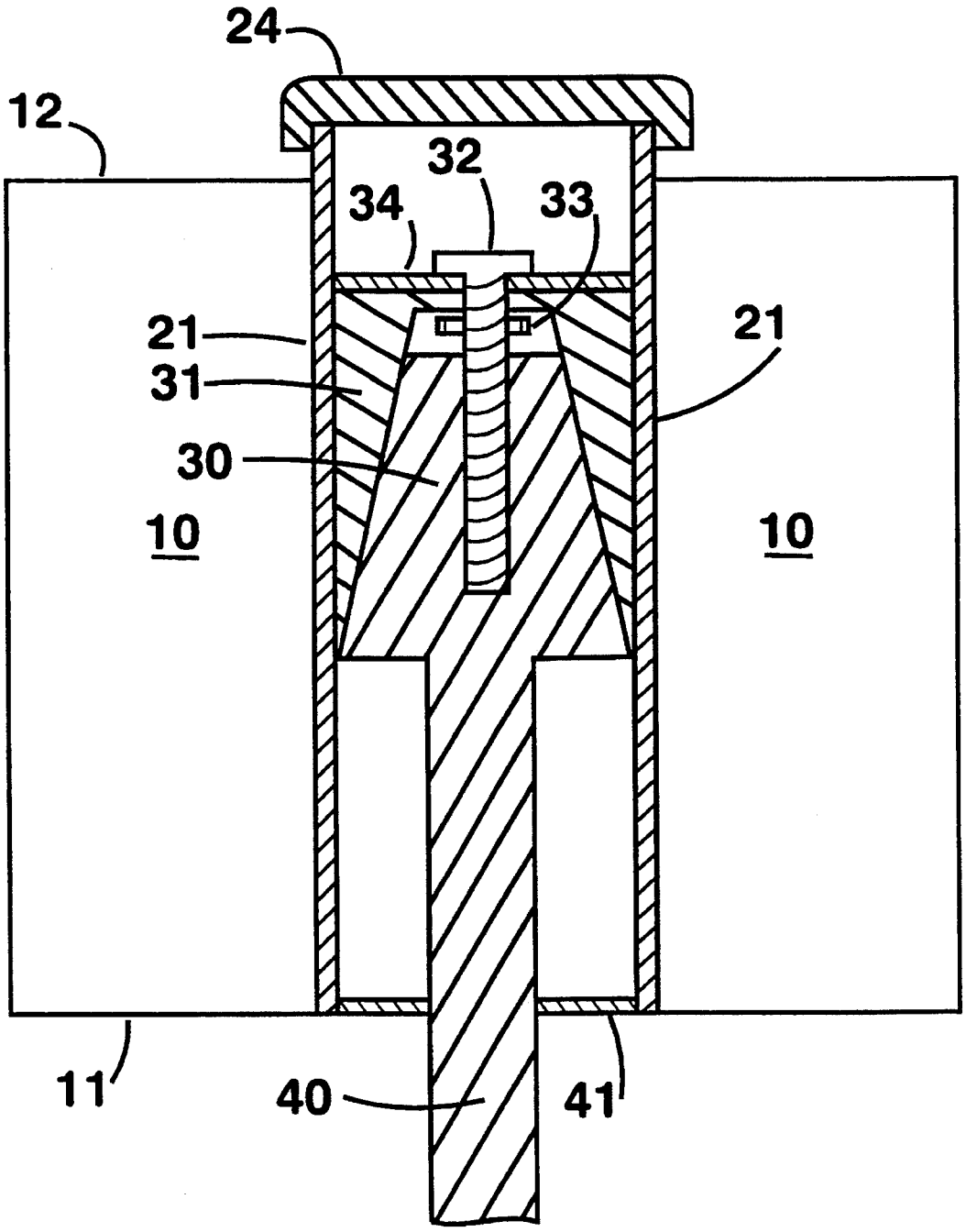
FIG. 3 is cross section port to starboard through Screw 32 of an alternate embodiment of the invention.

While the invention has been described in conjunction with specific embodiment thereof, it is evident that many alternatives, modifications, and variations will be apparent to those skilled in the art in light of the forgoing description. For example, FIG. 4 shows a modified toggle jaw that could be used instead of Screw 32. Arm 51 in FIG. 4, in a vertical position, is used to tighten or loosen Toggle bolt 52. Arm 51 as shown in FIG. 5 can then be laid horizontally on top of Wedge 31. This modified toggle jaw will eliminate the need for a screw driver to tighten Screw 32. FIG. 3 shows another variation. Two Wedge 31's are used, one on each side of Fin base 30 parallel to Spaced side walls 21 of Fin box 20. The wedges in this variation could be made of hard rubber. A hard rubber wedge could act as a shock absorber for Fin 40. Fin 40 receives a lot of impact when landing a jump. This variation requires the use of Washer plate 34 between Screw 32 and rubber Wedge 31. Another variation would be to make Fin base 30 only marginally smaller than Spaced end walls 22. In this example, Fin 40 is only allowed to be adjusted vertically. In this variation Gasket 41 could be made of fiberglass cloth and epoxy resin molded around a particular Fin 40. A solid Gasket 41 might create less drag than a rubber Gasket 41. Accordingly, it is intended to embrace all such alternatives, modifications, and variations as fall within the spirit and broad scope of the appended claims.

I claim:

1. A watercraft containing a fin box system, said fin box system comprising a chamber and a fin that can travel vertically, horizontally and at an angle within said chamber; said chamber is fixed within said watercraft, and said fin having means to expand against said chamber and against said fin such that said fin can be fixed at an infinite number of positions within said chamber.

2. The fin system of claim 1 where in said means to expand against said chamber and against said fin can be contracted such that said fin can be releasably fixed at an infinite number of positions within said chamber.

3. The fin box system of claim 1 where in said fin is adapted to have a fin base to facilitate movement of said fin within said chamber.

4. A watercraft containing a fin box system, said fin box system comprising a chamber and a fin that can travel vertically within said chamber; said chamber is fixed within said watercraft, and said fin having means to expand against said chamber and against said fin such that said fin can be fixed at an infinite number of positions within said chamber.

5. The fin box system of claim 4 where in said means to expand against said chamber and against said fin can be contracted such that said fin can be releasably fixed at an infinite number of positions within said chamber.

6. The fin system of claim 4 where in said fin is adapted to have a fin base to facilitate movement of said fin within said chamber.

* * * * *